US005375346A

United States Patent [19]

Cole et al.

[11] Patent Number: 5,375,346

[45] Date of Patent: Dec. 27, 1994

[54] THRUST PRODUCING SHOE SOLE AND HEEL IMPROVED STABILITY

[75] Inventors: George S. Cole, Pebble Beach, Calif.; Harry W. Edwards, Barrington, Ill.; Stuart E. Jenkins, Thousand Oaks; Karl M. Schmidt, Woodside, both of Calif.

[73] Assignee: Energaire Corporation, Pebble Beach, Calif.

[21] Appl. No.: 42,049

[22] Filed: Apr. 2, 1993

[51] Int. Cl.[5] ..... A43B 13/18; A43B 13/20

[52] U.S. Cl. ..... 36/29; 36/28

[58] Field of Search ..... 36/28, 29, 27, 35 R, 36/35 B

[56] References Cited

U.S. PATENT DOCUMENTS

| | | | |
|---|---|---|---|
| 1,115,875 | 11/1914 | Tousley et al. | 36/35 B |
| 1,977,695 | 10/1934 | Pinaud . | |
| 2,128,134 | 8/1938 | Giusto . | |
| 2,434,770 | 1/1948 | Lutey . | |
| 2,814,133 | 11/1957 | Herbst . | |
| 3,100,354 | 8/1963 | Lombard et al. . | |
| 3,225,463 | 12/1965 | Burnham . | |
| 3,871,117 | 3/1975 | Richmond et al. . | |
| 4,071,963 | 2/1978 | Fukuoka . | |
| 4,237,625 | 12/1980 | Cole et al. . | |
| 4,262,433 | 4/1981 | Hagg et al. . | |
| 4,358,902 | 11/1982 | Cole et al. . | |
| 4,389,798 | 6/1983 | Tilles . | |
| 4,446,634 | 5/1984 | Johnson et al. . | |
| 4,449,307 | 5/1984 | Stubblefield . | |
| 4,458,430 | 7/1984 | Peterson . | |
| 4,574,498 | 3/1986 | Norton et al. . | |
| 4,577,417 | 3/1986 | Cole . | |
| 4,697,361 | 10/1987 | Ganter et al. . | |
| 4,856,208 | 8/1989 | Zaccaro | 36/29 |
| 4,890,398 | 1/1990 | Thomasson . | |
| 4,897,936 | 2/1990 | Fuerst . | |
| 4,914,838 | 4/1990 | Ihlenburg . | |

FOREIGN PATENT DOCUMENTS

| | | | |
|---|---|---|---|
| 643881 | 6/1964 | France . | |
| 871261 | 5/1953 | Germany . | |
| 1287477 | 7/1961 | Germany . | |
| 2800359 | 7/1979 | Germany | 36/28 |
| 16143 | of 1892 | United Kingdom . | |
| 2114425 | 8/1983 | United Kingdom | 36/28 |

*Primary Examiner*—Steven N. Meyers
*Attorney, Agent, or Firm*—Emrich & Dithmar

[57] ABSTRACT

A shoe sole and heel member has a sole portion and a heel portion. Bulges are molded into the heel portion and the metatarsal region of the sole portion defining heel and metatarsal cavities. Passageways between the cavities enable air to move back and forth therebetween. A sealing member is attached to the sole and heel member to hermetically seal the air in the cavities and the passageways. In one embodiment, a single U-shaped heel cavity communicates with a single metatarsal cavity through a Y-shaped passageway. Rigid stabilizers laterally flank the cavity-defining bulges. In another embodiment the heel cavity has forward and rearward portions interconnected by a narrow channel, the portions respectively communicating through separate passageways with opposite sides of the metatarsal cavity, with oppositely-directed one-way valves in the passageways. In a third embodiment, there are two separate metatarsal cavities and two separate heel cavities respectively intercommunicating through two passageways.

5 Claims, 6 Drawing Sheets

THRUST PRODUCING SHOE SOLE AND HEEL IMPROVED STABILITY

BACKGROUND OF THE INVENTION

1. Field of the Invention

The present invention relates to shoe sole and heel constructions and, in particular, to such constructions with fluid-filled cavities for providing cushioning and forward thrust.

2. Description of the Prior Art

Various types of shoe sole and heel constructions having fluid-containing cavities have heretofore been provided, such constructions being disclosed, for example, in U.S. Pat. Nos. 4,237,625, 4,358,902 and 4,577,417. The present invention is, in particular, an improvement of the construction disclosed in U.S. Pat. No. 4,577,417, which discloses a molded outer sole and heel member which has heel and metatarsal bulges molded therein to define cavities and a passageway extending between the cavities. Air, at atmospheric pressure, moves back and forth between the cavities through the passageway during movement of a person wearing the shoe.

These prior sole and heel structures have provided cushioning for the user's foot and have also provided forward thrust which facilitates walking or running movements. One difficulty which has arisen with respect to such prior shoe sole and heel constructions is that the bulges may tend to produce a lateral instability in the shoe, causing the shoe to tilt laterally inwardly or outwardly in use, resulting in pronation of the wearer's feet. For example, in walking and jogging gaits, wherein the initial shoe strike is at the heel, the initial point of impact is typically at the laterally outer side of the heel, i.e., at the right side of the right heel and the left side of the left heel. Thus, there is a tendency for the fluid in the heel cavity to move from side to side, as well as toward the metatarsal cavity.

Furthermore, it has been found that better control is needed of the time, location and direction of the air flows within the shoe sole and heel construction to improve the cushioning effect.

SUMMARY OF THE INVENTION

It is a general object of the invention to provide an improved shoe sole and heel which avoids the disadvantages of prior constructions while affording additional structural and operating advantages.

An important feature of the invention is the provision of a shoe sole and heel of the type which includes fluid-filled cavities and communicating passageways therebetween, which optimize the cushioning effect of the fluid.

Another feature of the invention is the provision of a shoe sole and heel of the type set forth, which has improved lateral stability.

Yet another feature of the invention is the provision of a shoe sole and heel of the type set forth, which is of relatively simple and economical construction.

These and other features of the invention are attained by providing a thrust producing shoe sole and heel comprising: a sole and heel member including sole and heel portions and having interior and exterior surfaces, the sole portion including a metatarsal bulge structure projecting from the exterior surface and defining a metatarsal cavity formation underlying only the metatarsal ball area of a foot for which the member is sized and opening at the interior surface, the heel portion including a heel bulge structure projecting from the exterior surface and defining a heel cavity formation underlying only the heel area of a foot for which the member is sized and opening at the interior surface, the bulge structures being resilient and wear-resistant, the member defining a restricted passageway opening at the interior surface and including a first portion communicating with the metatarsal cavity formation and two second portions branching from the first portion and communicating therewith and communicating with the heel cavity formation at laterally spaced-apart locations, sealing means overlying the cavity formations and the passageway and secured to the interior surface in a fluid-proof manner, and fluid sealed in the cavity formations and the passageway, whereby at rest a foot on the member is cushioned comfortably on the fluid in the cavity formations, and in moving such fluid alternates through the passageway between the heel and metatarsal cavity formations so as to provide shock absorption and to produce an alternate lifting effect by the bulge structures which provide forward thrust both in the heel portion and in the sole portion that facilitates moving.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there are illustrated in the accompanying drawings preferred embodiments thereof, from an inspection of which, when considered in connection with the following description, the invention, its construction and operation, and many of its advantages should be readily understood and appreciated.

DESCRIPTION OF THE PREFERRED EMBODIMENTS

Figure 1:
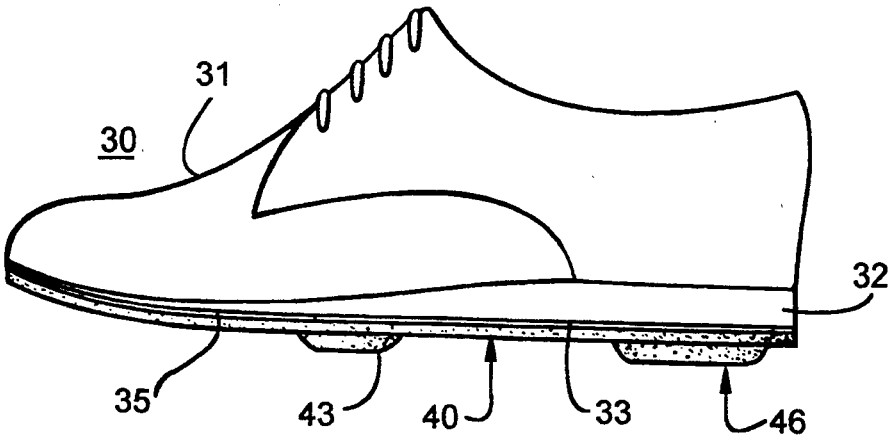
FIG. 1 is a side elevational view of a shoe incorporating a sole and heel member in accordance with one embodiment of the present invention.
Figure 2:
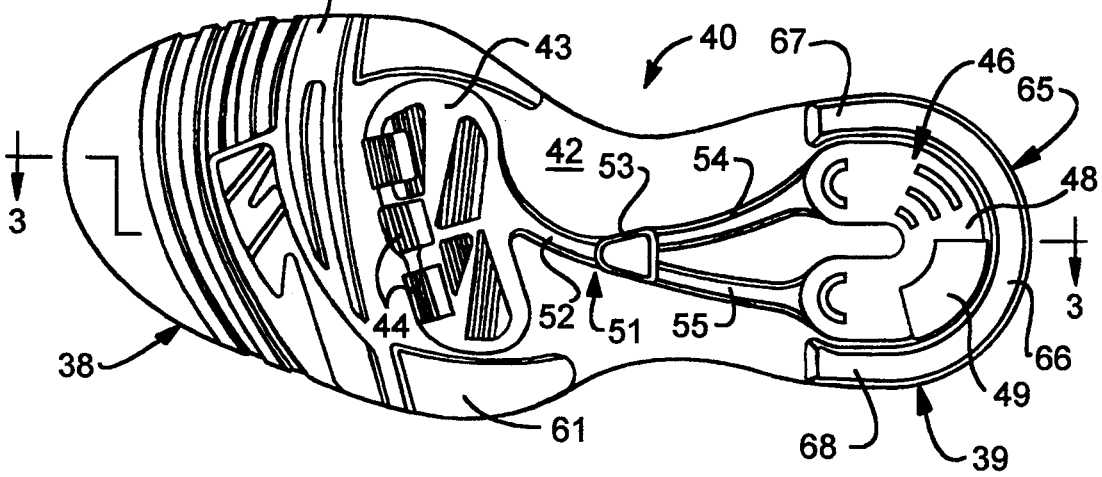
FIG. 2 is an enlarged bottom plan view of the outer sole and heel member of the shoe of FIG. 1.
Figure 3:
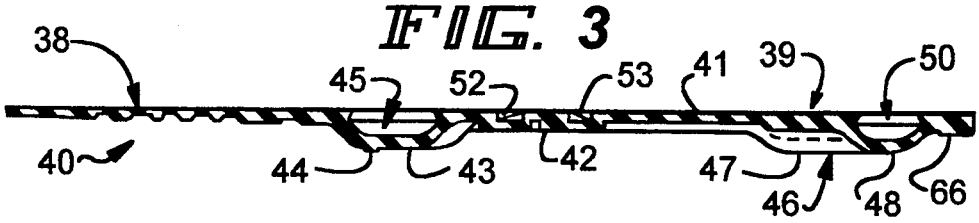
FIG. 3 is a view in vertical section taken along the line 3—3 in FIG. 2.

Referring to FIG. 1, there is illustrated a shoe 30 having a conventional upper portion or last 31 and a so-called midsole 32 which is generally of wedge shape, whereby the shoe 30 is referred to as being of the "wedge" type. The midsole 32 has a downwardly facing outer surface 33.

Referring also to FIGS. 2, 3 and 5-9, the shoe 30 further includes an outer sole and heel member 40, which comprises a generally flat, thin, elongated member of one-piece molded construction, preferably rubber. The sole and heel member 40 is formed of a highly wear resistant composition since it is subject to constant engagement with the pavement or other underlying support surface, which will hereinafter be referred to as the "ground." The sole and heel member 40 has a sole portion 38 located under the sole of a wearer's foot and a heel portion 39 located under the heel of the wearer's foot. The sole and heel member 40 has a substantially planar interior surface 41 and an exterior surface 42 which is disposed for contact with the ground. The exterior surface 42 may have an irregular tread pattern formed therein to enhance frictional engagement with the ground. Portions of the tread pattern may be molded of different material compositions.

A metatarsal bulge 43 is molded into the sole portion 38 in the metatarsal region thereof and projects downwardly from the exterior surface 42. The metatarsal bulge 43 extends generally laterally across the sole portion 38 and underlies the metatarsal ball area of a wearer's foot for which the sole and heel member 40 is sized. The metatarsal bulge 43 may be provided with reinforcing tread areas 44 and it defines a metatarsal cavity 45 which opens upwardly at said interior surface 41. Also molded in the heel portion 39 of the sole and heel member 40 is a heel bulge 46 which projects downwardly from the exterior surface 42. The heel bulge 46 is generally U-shaped, including a pair of laterally spaced-apart and forwardly projecting legs 47 interconnected at the rear ends thereof by a bight 48. The heel bulge 46 may be provided with a reinforcing tread area 49 along the rear outer edge thereof. The heel bulge 46 defines a generally U-shaped heel cavity 50 which opens upwardly at the interior surface 41.

A restricted passageway 51 is molded into the sole and heel member 40 between the metatarsal and heel cavities 45 and 50 and opens upwardly at the interior surface 41. The passageway 51 is generally Y-shaped, including a forward arm 52 which communicates with the metatarsal cavity 45 generally centrally thereof and branches at a junction 53 into two rearward arms 54 and 55 which communicate with the heel cavity 50, respectively at the forward ends of the legs 47 of the heel bulge 46. An adhesive layer 35 is disposed between the interior surface 41 of the sole and heel member 40 and the outer surface 33 of the midsole 32 for fixedly securing the two together in a fluid-tight manner. In this regard, it will be appreciated that the midsole 32 and the sole and heel member 40 are formed of fluid-impermeable materials and are also resilient to accommodate flexing during use of the shoe 30. Thus, the midsole 32 and the sole and heel member 40 cooperate to hermetically seal the metatarsal and heel cavities 45 and 50 and the passageway 51, permanently trapping air at atmospheric pressure therein.

In use, the bulges 43 and 46 engage the ground as the wearer of the shoe 30 is standing. The air in the cavities 45 and 50 provides a cushioning effect. In walking and running, the heel bulge 46 first comes into contact with the ground causing air in the cavity 50 to be compressed and forced through the passageway 51 into the metatarsal cavity 45. As the heel portion 39 lifts off the ground and the metatarsal bulge 43 contacts the ground, the air in the cavity 45 is forced through the passageway 51 back into the heel cavity 50 to give a lifting effect. Thus, in walking and running, the air alternates back and forth between the cavities 45 and 50 through the passageway 51 to give an alternate lifting effect and provide thrust both at the metatarsal ball area and in the heel area that facilitates walking and running.

It is a significant aspect of the invention that the branched construction of the passageway 51 serves to reduce the tendency toward lateral tilting or pronation of the wearer's foot during any gait, such as walking or jogging, wherein the heel strikes the ground first. More specifically, when the heel portion 39 strikes the ground, typically at the laterally outer side of heel, while a portion of the air in the heel cavity 50 will be forced from the outer leg 47 to the inner leg 47, a portion will be immediately forced into the rearward arm 55 of the passageway 51, and that portion of the air which is forced into the inner leg 47 will also go immediately into the rearward arm 54 of the passageway 51. Thus, there will be no buildup of pressure in the inner leg 47 which might tend to cause a tilting or rocking of the wearer's foot.

Figure 4:
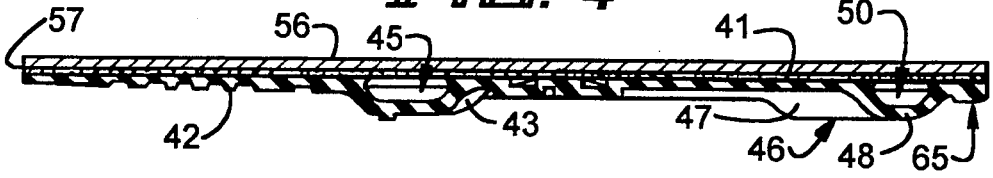
FIG. 4 is a view similar to FIG. 3, and illustrating the sole and heel member with a sealing member attached.
Figure 5:
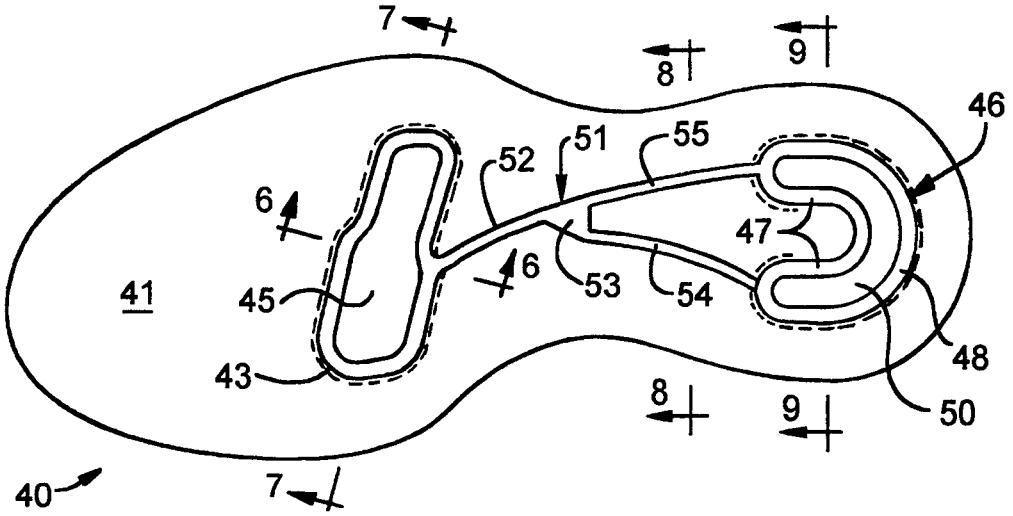
FIG. 5 is a top plan view of the sole and heel member of FIG. 2.
Figure 6:
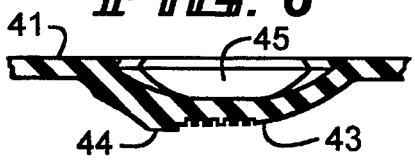
FIG. 6 is an enlarged, fragmentary view in vertical section taken along the line 6—6 in FIG. 5.
Figure 7:
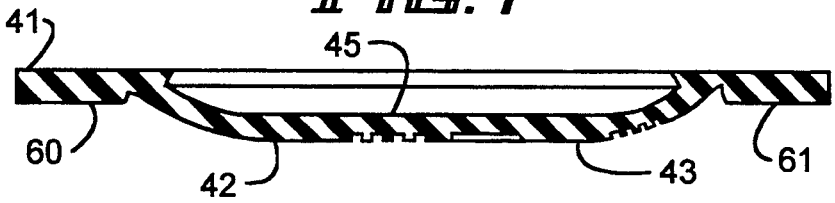
FIG. 7 is an enlarged view in vertical section taken along the line 7—7 in FIG. 5.
Figure 8:
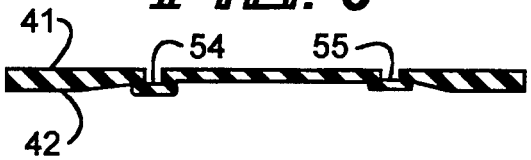
FIG. 8 is an enlarged view in vertical section taken along the line 8—8 in FIG. 5.
Figure 9:
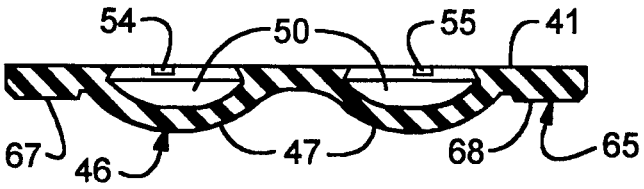
FIG. 9 is an enlarged view in vertical section taken along the line 9—9 in FIG. 5.

Referring in particular to FIG. 4, an alternative embodiment is depicted which is intended for the replacement market. In the embodiment of FIG. 4, the identical outer sole and heel member 40 is utilized. A sealing membrane 56 is utilized which has a shape that matches the shape of the sole and heel member 40 and is adhesively secured, as by an adhesive layer 57 to the interior surface 41 of the sole and heel member 40, permanently attaching the two together and providing a hermetic seal of the cavities 45 and 50 and the passageway 51, trapping air at atmospheric pressure therein.

In order to further inhibit lateral tilting of the wearer's foot in use, the sole and heel member 40 is provided with forward stabilizers 60 and 61 which depend from the exterior surface 42 thereof respectively along the laterally inner and outer ends of the metatarsal bulge 43. A generally U-shaped rear stabilizer 65 depends from the exterior surface 42 at the heel portion 39 so as to encompass the heel bulge 46, the rear stabilizer 65 having a bight 66 and forwardly projecting legs 67 and 68. The forward stabilizers 60 and 61 are respectively disposed at the lateral side edges of the sole and heel member 40, as are the legs 67 and 68 of the rear stabilizer 65, and they depend from the exterior surface 42 a distance substantially less than the downward extent of the metatarsal and heel bulges 43 and 46, so as not to interfere with the contact of the bulges 43 and 46 with the ground. However, if, when either of the bulges 43 and 46 is compressed, the shoe 30 starts to tilt to one side or the other, the corresponding one of the forward stabilizers 60 and 61 or the legs 67 and 68 of the rear stabilizer 65 will engage the ground to limit such tilting movement. In this regard, it will be appreciated that each of the stabilizers 60, 61 and 65 is relatively rigid as compared to the bulges 43 and 46.

Figure 10:
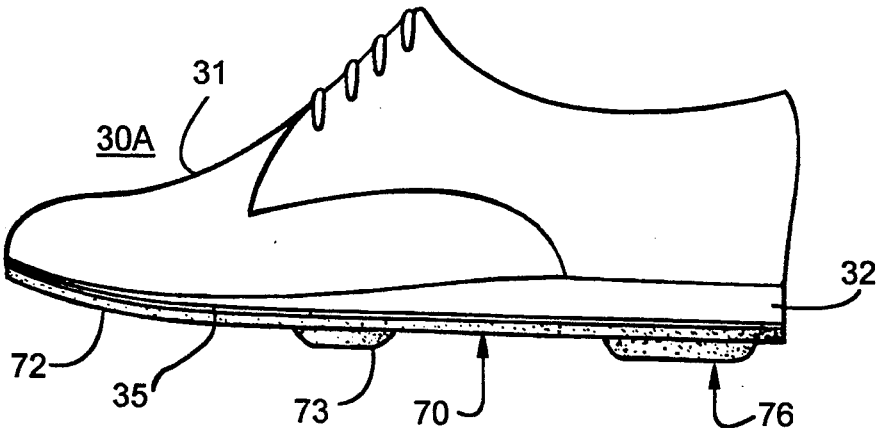
FIG. 10 is a view similar to FIG. 1 of a shoe incorporating a sole and heel member in accordance with another embodiment of the present invention.
Figure 11:
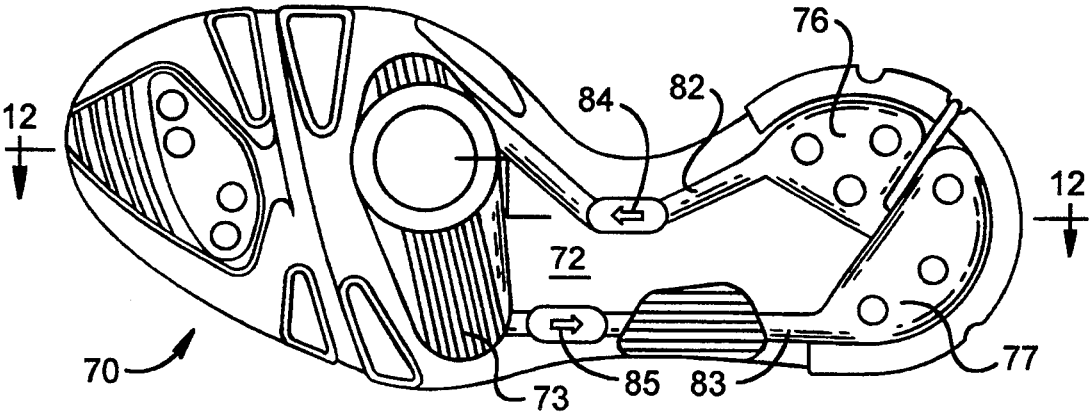
FIG. 11 is an enlarged bottom plan view of the sole and heel member of the shoe of FIG. 10.
Figure 12:
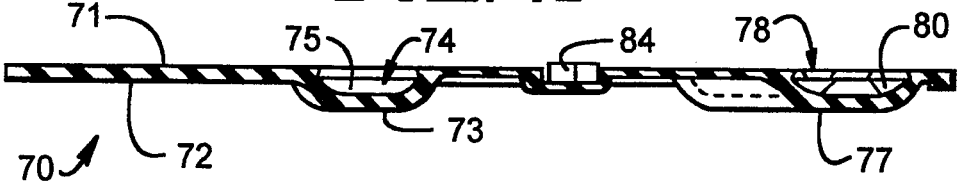
FIG. 12 is a view in vertical section taken along the line 12—12 in FIG. 11.

Referring now to FIG. 10, there is illustrated a shoe 30A, which is substantially identical to the shoe 30 of FIG. 1, except that it includes a sole and heel member 70 which is of one-piece molded construction similar to that of the sole and heel member 40 described above, having an interior surface 71 and an exterior surface 72.

Referring also to FIGS. 11, 12 and 14–16, there is molded in the sole and heel member 70 and depending from the exterior surface 72 a metatarsal bulge 73, which extends generally laterally across the sole and heel member 70 and underlies the metatarsal ball area of the foot of a wearer for which the shoe 30A is sized. The bulge 73 defines a cavity formation 74 which, in this instance, is a single laterally elongated metatarsal cavity 75 which opens upwardly at the interior surface 71. Also molded in the sole and heel member 70 and depending from the exterior surface 72 are two heel bulges 76 and 77 which underlie the heel area of user's foot for which the shoe 30A is sized, and open upwardly at the interior surface 71. The heel bulge 76 is generally triangularly shaped and is positioned toward the laterally inner edge of the heel, while the heel bulge 77 is generally semi-circular in shape and is positioned toward the laterally outer side of the heel. The heel bulge 76 projects forwardly of the heel bulge 77. The bulges 76 and 77, respectively, define heel cavities 79 and 80 which cooperate to form a cavity formation 78, which opens upwardly at the interior surface 71. Communication between the cavities 79 and 80 is provided by a restricted channel 81 which is also molded in the sole and heel member 70 and opens upwardly at the interior surface 71.

Communication between the metatarsal cavity 75 and the heel cavities 79 and 80 is provided by passageways 82 and 83 which are molded in the sole and heel member 70 and open upwardly at the interior surface 71. More specifically, the passageway 82 extends along the laterally inner side of the sole and heel member 70 from the forward end of the heel cavity 79 to the laterally inner portion of the metatarsal cavity 75, while the passageway 83 extends along the laterally outer edge of the sole and heel member 70, providing communication between the adjacent side of the metatarsal cavity 75 and the forward end of the heel cavity 80. Respectively provided in the passageways 82 and 83 are one-way valves 84 and 85, the valve 84 preventing flow of fluid through the passageway 82 toward the heel cavity formation 78, and the valve 85 preventing fluid flow through the passageway 83 toward the metatarsal cavity formation 74.

It will be appreciated that the sole and heel member 70 is fixedly secured by the adhesive layer 35 to the midsole 32 in the same manner as was described above in connection with the shoe 30, thereby hermetically sealing the cavities 75, 79 and 80 and the passageways 82 and 83, trapping air therein under atmospheric pressure.

In use, the operation of the shoe 30A is similar to that described above for the shoe 30, except that in this case the transfer of air between the metatarsal and heel cavity formations 74 and 78 is in a one-way loop. More specifically, when the heel of the shoe 30A strikes the ground, the heel bulge 77 will strike first, compressing the air in the cavity 80 and driving it through the channel 81 into the cavity 79 and thence through the passageway 82 and the one-way valve 84 to the metatarsal cavity 75. Because the heel cavity 79 is disposed forwardly of the heel cavity 80, the lateral or side-to-side component of movement of the air therebetween is significantly reduced, thereby reducing any tendency toward lateral tilting of the shoe 30A. As the wearer's foot naturally rolls inwardly during the walking or running movement, the cavity 79 is compressed, continuing to drive air forwardly through the passageway 82. When the metatarsal bulge 73 strikes the ground, the air in the cavity is compressed and is driven rearwardly through the passageway 83 and the one-way valve 85 into the heel cavity 80.

Figure 13:
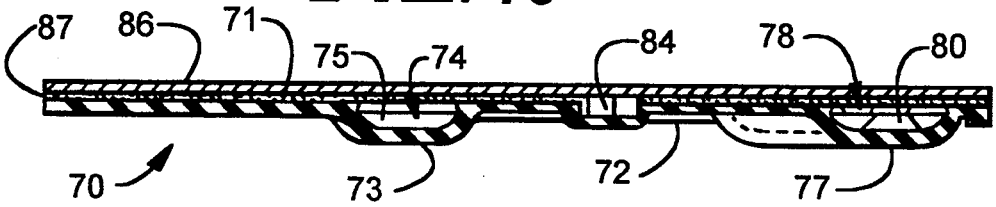
FIG. 13 is a view similar to FIG. 12 showing the sole and heel member with a sealing member attached.
Figure 14:
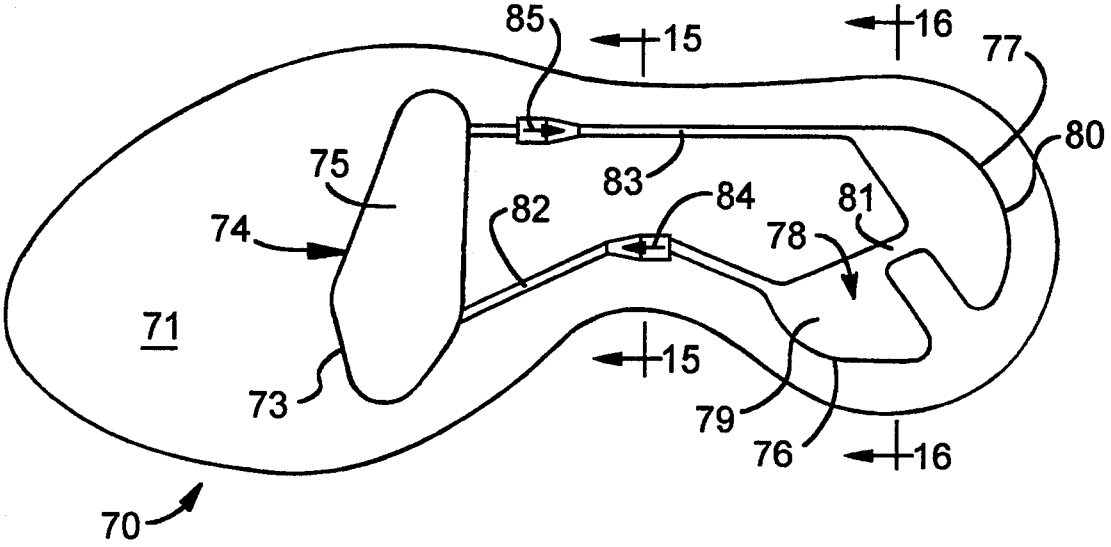
FIG. 14 is a top plan view of the sole and heel member of FIG. 11.
Figure 15:
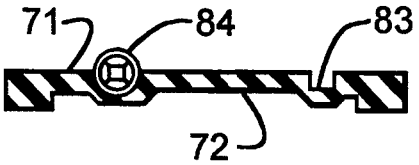
FIG. 15 is an enlarged view in vertical section taken along the line 15—15 in FIG. 14.
Figure 16:
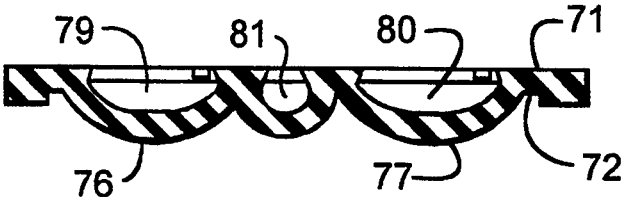
FIG. 16 is an enlarged view in vertical section taken along the line 16—16 in FIG. 14.

Referring to FIG. 13, there is illustrated an embodiment intended for the replacement market, in which the sole and heel member 70 is covered by a sealing membrane 86, which is adhesively secured by an adhesive layer 87 to the interior surface 71 of the sole and heel member 70, thereby hermetically sealing the cavities 75, 79 and 89 and the passages 82 and 83 and trapping air therein in the same manner as was described above in connection with the embodiment of FIG. 4.

Figure 17:
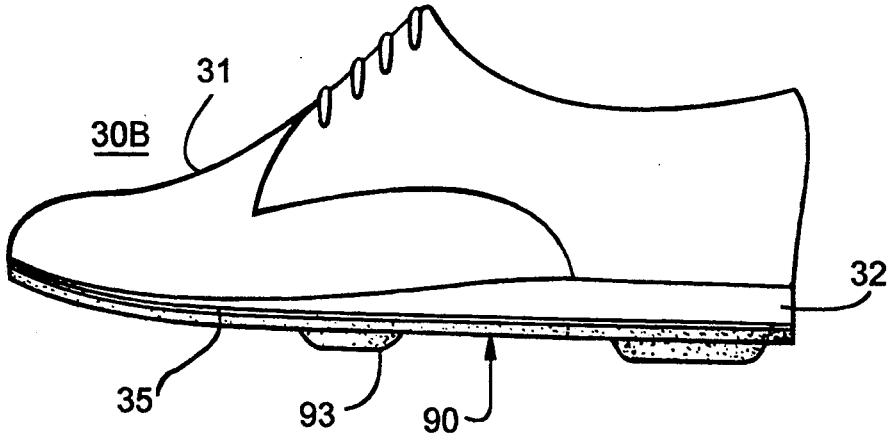
FIG. 17 is a view similar to FIG. 1 illustrating a shoe incorporating a sole and heel member in accordance with another embodiment of the present invention.
Figure 18:
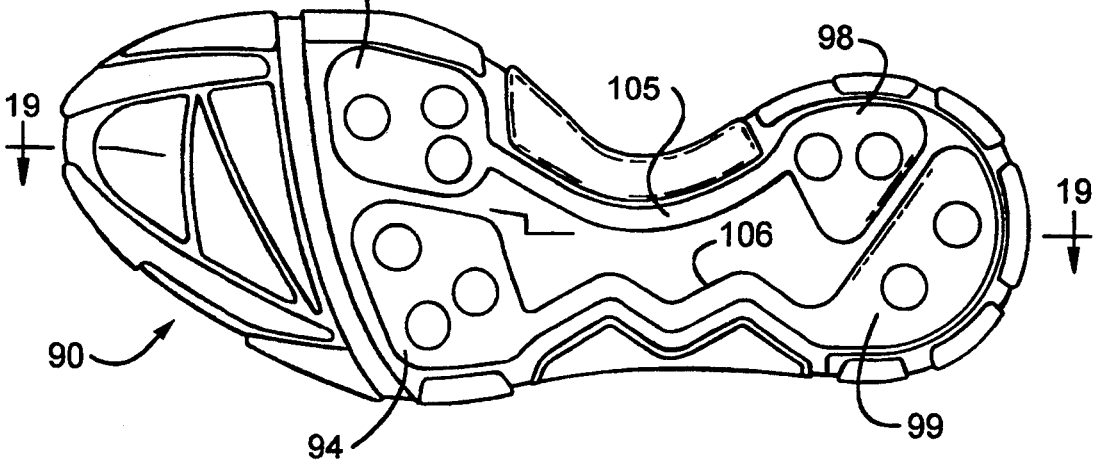
FIG. 18 is an enlarged bottom plan view of the sole and heel member of the shoe of FIG. 17.
Figure 19:
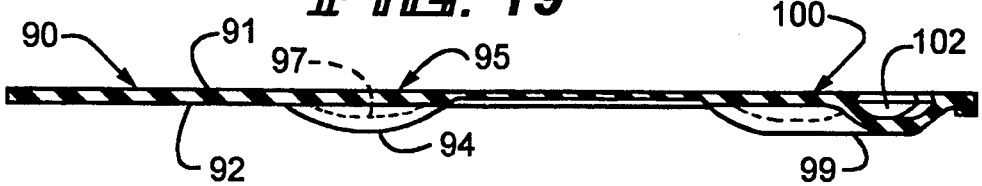
FIG. 19 is a view in vertical section taken along the line 19—19 in FIG. 18.

Referring now to FIG. 17, there is illustrated a shoe 30B, which is identical to the shoe 30A, except that it is provided with a sole and heel member 90. Referring further to FIGS. 18, 19 and 21–24, the sole and heel member 90 is of one-piece molded construction, having an interior surface 91 and an exterior surface 92. Two laterally spaced-apart metatarsal bulges 93 and 94 are molded in the sole and heel member 90 and depend from the exterior surface 92, being positioned so as to underlie only the metatarsal ball area of a wearer's foot for which the shoe 30B is sized. The bulges 93 and 94 respectively define metatarsal cavities 96 and 97 of a metatarsal cavity formation 95, each of the cavities 96 and 97 being generally in the shape of a parallelogram and opening upwardly at the interior surface 91.

Also molded in the sole and heel member 90 and depending from the exterior surface 92 are two heel bulges 98 and 99, which are respectively shaped and positioned in substantially the same manner as the heel bulges 76 and 77 described above in connection with FIG. 11. The heel bulges 98 and 99 respectively define heel cavities 101 and 102 of a heel cavity formation 100, which opens upwardly at the interior surface 91. The heel cavities 101 and 102 are respectively similar to the heel cavities 79 and 80, described above, except that they are spaced-apart with no communication therebetween.

Also molded in the sole and heel member 90 and opening upwardly at the interior surface 91 thereof are two elongated passageways 105 and 106. More specifically, the passageway 105 follows a generally curved path adjacent to the laterally inner side of the sole and heel member 90 and provides communication between the forward end of the heel cavity 101 and the metatarsal cavity 96. The passageway 106 extends generally along the laterally outer side of the sole and heel member 90, providing communication along a zigzag path between the forward end of the heel cavity 102 and the metatarsal cavity 97.

It will be appreciated that the sole and heel member 90 is secured to the shoe midsole 32 in the same manner as was described above in connection with the shoes 30 and 30A, so as to trap air under atmospheric pressure in the cavities 96, 97, 101, and 102 and the passageways 105 and 106. In operation, when the heel bulges 98 and 99 strike the ground, the air in the cavities 101 and 102 is compressed and forced forwardly through the passageways 105 and 106 to the metatarsal cavities 96 and 97. Since the metatarsal cavities 96 and 97 are spaced apart, as are the heel cavities 101 and 102, no lateral or side-to-side air movement therebetween is possible, so as to prevent any tendency toward promoting lateral tilting of the shoe 30B.

Figure 20:
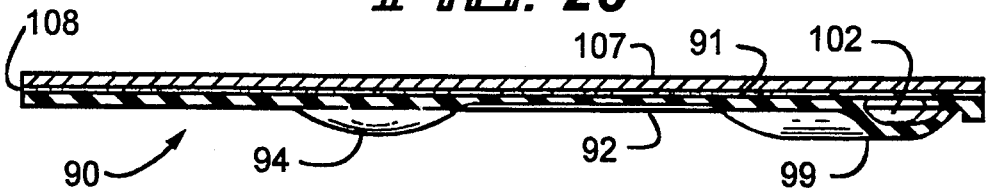
FIG. 20 is a view similar to FIG. 19, illustrating the sole and heel member with a sealing member attached.
Figure 21:
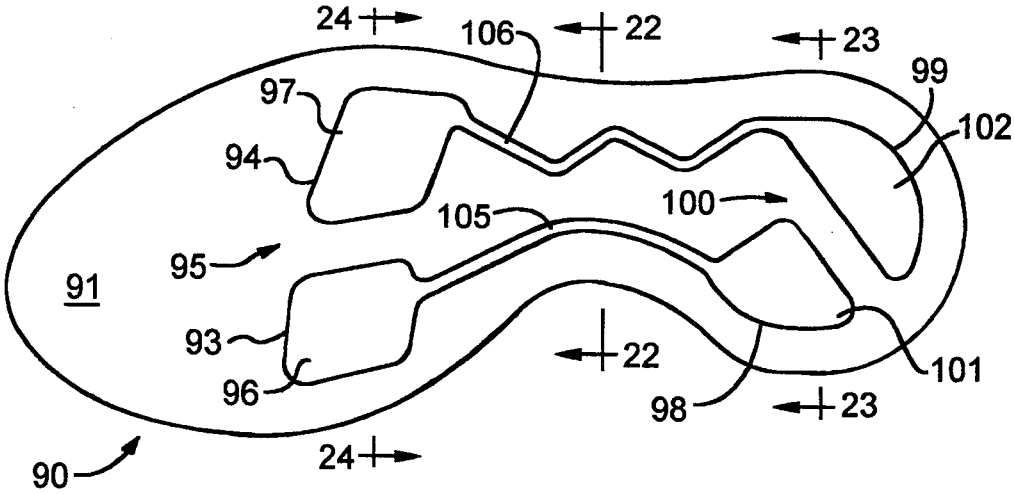
FIG. 21 is a top plan view of the sole and heel member of FIG. 18.
Figure 22:
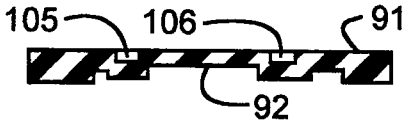
FIG. 22 is an enlarged view in vertical section taken along the line 22—22 in FIG. 21.
Figure 23:
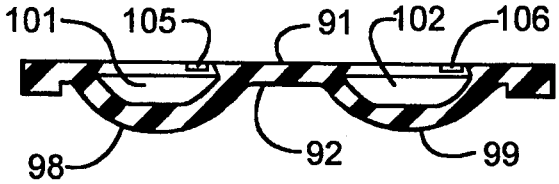
FIG. 23 is an enlarged view in vertical section taken along the line 23—23 in FIG. 21.
Figure 24:
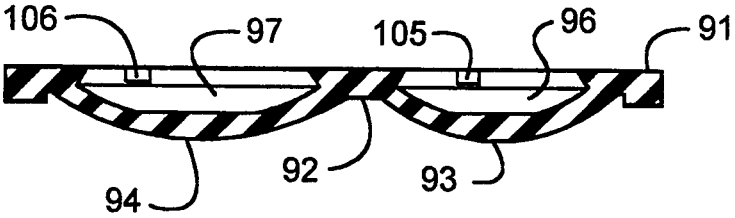
FIG. 24 is an enlarged view in vertical section taken along the line 24—24 in FIG. 21.

Referring to FIG. 20, there is illustrated another embodiment intended for the replacement market, in which the sole and heel member 90 is covered with a fluid-impermeable sealing membrane 107 which is secured by an adhesive layer 108 to the interior surface 91 of the sole and heel member 90, thereby hermetically sealing the cavities 96, 97, 101 and 102 and the passageways 105 and 106 in the same manner as was described above in connection with FIGS. 4 and 13.

It will be appreciated that, if desired, stabilizers similar to the stabilizers 60, 61 and 65 described in connection with FIGS. 1–9, could be provided on either of the sole and heel members 70 and 90 to further inhibit any lateral tilting of the shoes 30A and 30B.

While the present invention is described with the use of air under atmospheric pressure in the cavities and passageways of the sole and heel members, it will be appreciated that other fluids and other pressures could be utilized.

From the foregoing, it can be seen that there has been provided an improved sole and heel construction which provides effective cushioning and forward thrust while at the same time inhibiting any tendency toward lateral tilting of the shoe.

I claim:

1. A thrust producing shoe sole and heel comprising: a sole-and-heel member including a sole portion and a heel portion and having interior and exterior surfaces and laterally inner and outer side edges and forward and rearward ends, said sole portion including a flexible and wear-resistant metatarsal bulge structure projecting from said exterior surface and defining a metatarsal cavity formation underlying only the metatarsal ball area of a foot for which said member is sized and opening at said interior surface, said heel portion including a flexible and wear-resistant heel bulge structure projecting from said exterior surface and defining a heel-cavity formation underlying only the heel area of a foot for which said member is sized and opening at said interior surface, said heel cavity formation including only first and second portions respectively disposed adjacent to said inner and outer side edges with said first portion disposed forwardly of said second portion, said member defining first and second discrete restricted passageways opening at said interior surface, said first passageway communicating with only said first portion of said heel cavity formation and a first location of said metatarsal cavity formation, said second passageway communicating with only said second portion of said heel cavity formation and a second location of said metatarsal cavity formation, said first and second restricted passageways being spaced apart along their entire length, cavity closing material overlying said cavity formations and said passageways and secured to said interior surface in a fluid-proof manner, and fluid sealed in said cavity formations and said passageways, whereby at rest a foot on said member is cushioned comfortably on the fluid in said cavities and in moving said fluid alternates through said passageways between said heel and metatarsal cavity formations so as to provide shock absorption and to produce an alternating lifting effect by said bulge structures which provided forward thrust both in said heel portion and in said sole portion that facilitates moving.

2. The shoe sole and heel of claim 1, wherein said first and second portions of said heel cavity formation are separate from each other.

3. The shoe sole and heel of claim 2, wherein said metatarsal cavity formation includes first and second discrete and spaced-apart portions on which said first and second locations are respectively disposed.

4. The shoe sole and heel of claim 2, wherein said metatarsal cavity formation includes first and second portions respectively disposed adjacent to said inner and outer side edges and respectively communicating with said first and second restricted passageways.

5. The shoe sole and heel of claim 4, wherein said metatarsal cavity formation includes first and second discrete and spaced-apart portions on which said first and second locations are respectively disposed.

* * * * *